US006965347B2

(12) United States Patent
Sugimoto et al.

(10) Patent No.: US 6,965,347 B2
(45) Date of Patent: Nov. 15, 2005

(54) VEHICULAR RADIO WAVE RECEIVER AND INFORMATION DISPLAYING APPARATUS WITH RADIO WAVE RECEIVER

(75) Inventors: Yuji Sugimoto, Okazaki (JP); Syuichi Kono, Okazaki (JP); Masahito Hirayama, Nishikamo-gun (JP); Tomoyuki Miyagawa, Nukata-gun (JP); Gorou Inoue, Obu (JP)

(73) Assignees: Nippon Soken, Inc., Nishio (JP); Denso Corporation, Kariya (JP)

( * ) Notice: Subject to any disclaimer, the term of this patent is extended or adjusted under 35 U.S.C. 154(b) by 85 days.

(21) Appl. No.: 10/651,094

(22) Filed: Aug. 29, 2003

(65) Prior Publication Data

US 2004/0041735 A1 Mar. 4, 2004

(30) Foreign Application Priority Data

Aug. 29, 2002 (JP) ..... 2002-251200
Apr. 18, 2003 (JP) ..... 2003-114323

(51) Int. Cl.[7] ..... H01Q 1/34
(52) U.S. Cl. ..... 343/713; 307/10.5
(58) Field of Search ..... 343/713, 711, 343/712, 715, 714, 700 MS; 307/10.5, 10.1

(56) References Cited

U.S. PATENT DOCUMENTS 5,959,581 A * 9/1999 Fusinski ..... 343/700 MS
5,971,552 A * 10/1999 O'Farrell et al. ..... 359/871
5,973,648 A * 10/1999 Lindenmeier et al. ..... 343/713
6,011,518 A * 1/2000 Yamagishi et al. ..... 343/713
6,052,084 A * 4/2000 Aoshima et al. ..... 342/358
6,431,712 B1 * 8/2002 Turnbull ..... 359/604
6,538,609 B2 * 3/2003 Nguyen et al. ..... 343/713
6,750,823 B2 * 6/2004 Turnbull et al. ..... 343/713

FOREIGN PATENT DOCUMENTS

JP A-H08-216735 8/1996

* cited by examiner

*Primary Examiner*—Don Wong
*Assistant Examiner*—Huedung X. Cao
(74) *Attorney, Agent, or Firm*—Posz Law Group, PLC

(57) ABSTRACT

A receiver includes a circuit board and a dielectric antenna. The circuit board has a receiving circuit on a first surface, and a ground pattern on a second surface. The circuit board is disposed close to a rear window of a vehicle so that the ground pattern faces a roof panel. The dielectric antenna extends from an edge of the circuit board toward and along the rear window. As a result, the roof panel capacitively couples with the ground pattern, so that the roof panel becomes imaginary ground. The dielectric antenna functions as a monopole antenna with the imaginary ground. It is not influenced with a metallic material of the vehicle.

4 Claims, 12 Drawing Sheets

VEHICULAR RADIO WAVE RECEIVER AND INFORMATION DISPLAYING APPARATUS WITH RADIO WAVE RECEIVER

CROSS REFERENCE TO RELATED APPLICATIONS

This application is based on Japanese Patent Applications No. 2002-251200 filed on Aug. 29, 2002 and No. 2003-114323 filed on Apr. 18, 2003, the contents of which are incorporated herein by reference.

BACKGROUND OF THE INVENTION

1. Field of the Invention

The present invention relates to a vehicular radio wave receiver and an information displaying apparatus with radio wave receiver.

2. Description of Related Art

Recently, various radio wave receivers are mounted on vehicles. A keyless entry system is used as a kind of the receivers in vehicles. The keyless entry system has a receiver and a transmitter. The receiver is mounted on a vehicle, and the transmitter is included in a key carried by a driver. The transmitter modulates signals that include an identification (ID) code and an operation code, and transmits the modulated signals to the receiver. When the receiver receives the modulated signals, it demodulates the signals and determines whether the demodulated ID code corresponds to an ID code of the receiver. Then, when the received ID code corresponds to the ID code of the receiver, the receiver sends control signals to electrical control units (ECU) in the vehicle so that the doors are opened or closed, and an engine is started. The keyless entry system generally uses weak signals in 300 MHz frequency band. The receiver is installed in an appropriate place so that the receiver can have a gain as high as possible.

In JP-A-H-08-216735, an instrument panel has a receiver and an antenna as well as a control circuit for controlling the instrument panel. In such a receiver, because the antenna is disposed close to a window of the vehicle, the receiver is less likely to be prevented from transmitting and receiving by a metallic body of the vehicle wherever the driver is.

It is desirable that a length of an element of the antenna corresponds to $\lambda/4$. Here, "$\lambda$" is a wavelength. However, because the instrument panel has a rectangular shape and is limited to a certain size, the instrument panel may not have an enough space for the antenna even when the element of the antenna is disposed in a lateral direction. On the other hand, if the element of the antenna is shorter than $\lambda/4$, sensitivity of the antenna becomes low.

A dielectric antenna, which measures approximately 20 millimeters (mm) by 5 mm by 5 mm, is known as a downsized antenna. If the dielectric antenna is used, the dielectric antenna can be easily installed inside the instrument panel because of its size.

A vehicular navigation system is used in the vehicle. In the vehicular navigation system, a control circuit of the navigation system is connected to a Global Positioning System (GPS) receiver. The GPS receiver receives GPS signals from GPS satellites, and sends them to the control circuit to calculate a position of the vehicle. In such a navigation system, the GPS receiver is separated from the control circuit. If the dielectric antenna is used for the GPS receiver, it is thinkable that the GPS receiver is installed inside the navigation system.

However, the dielectric antenna is easy to be influenced with a metal disposed close to the dielectric antenna and a condition of a ground because of a function of the dielectric.

If the dielectric antenna is influenced with those, a gain of the dielectric antenna is reduced. In such a situation, for example, in the keyless entry system, the receiver cannot receive the signals from the transmitter in a certain direction, so that the keyless entry system has a blind area. In the navigation system, it cannot calculate the position of the vehicle because the GPS receiver cannot receive GPS signals in a certain direction. Therefore, the dielectric antenna is useless for the receiver of the vehicle.

SUMMARY OF THE INVENTION

An object of the present invention is to provide a vehicular radio wave receiver and an information displaying apparatus with a radio wave receiver that has high receiving performance sufficient to use in a vehicle.

According to one aspect of the present invention, a radio wave receiver includes a circuit board and a dielectric antenna. The circuit board has a receiving circuit on a first surface, and a ground pattern on a second surface. The dielectric antenna receives a signal and sends it to the circuit board. The circuit board is disposed close to an edge of a panel of a vehicle so that the ground pattern closely faces an inner surface of the panel. The dielectric antenna is axially disposed along a window of the vehicle as extending from a peripheral portion of the circuit board close to an edge of the panel.

As a result, since the ground pattern on the second surface of the circuit board closely faces the inner surface of the panel of the vehicle, the panel capacitively couples with the ground pattern in a high frequency band, such as 300 MHz. The panel is fairly large compared with the ground pattern of the circuit board, so that the panel becomes imaginary ground that has low resistance. Accordingly, the dielectric antenna functions as an effective monopole antenna. In addition, since the dielectric antenna extends from the peripheral portion along the window, an influence of an induction between the dielectric antenna and the panel is prevented. Therefore, the vehicular radio wave receiver can have a sufficient gain of the antenna to use in the vehicle.

According to another aspect of the present invention, a vehicular radio wave receiver includes a circuit board and a dielectric antenna. The circuit board has a receiving circuit and a ground pattern. The dielectric antenna receives a signal and sends it to the circuit board. At least one side of the circuit board in a lateral direction or a longitudinal direction has $\lambda/4$ length. Here, "$\lambda$" is a wavelength. The dielectric antenna is disposed as extending from a peripheral portion of the circuit board to an outside of the circuit board. A ground pattern of the circuit board is an elongate form extended in a direction opposite to the dielectric antenna so that the dielectric antenna and the ground pattern function as elements of a dipole antenna.

Since one element of the dipole antenna is constructed of the dielectric antenna, the element can be far shortened as compared with $\lambda/4$. Accordingly, the other element, which is constituted of the ground pattern, of the dipole antenna can be approximately same length as $\lambda/4$, which is the length of the side of the circuit board. As a result, the dipole antenna has approximately $\lambda/2$ length that can have a high reception performance, and the vehicular radio wave receiver can be made compactly.

In addition, a ground electrical potential is prevented from changing with influence of wire harnesses, such as for feeding and sending control signals to the circuit board because the vehicular radio wave receiver has the dipole antenna. Therefore, the vehicular radio wave receiver can have a sufficient gain of the antenna to use in the vehicle.

According to a third aspect of the present invention, a vehicular radio wave receiver includes a circuit board and a dielectric antenna. The circuit board is housed in a housing of an inside rear view mirror, which is hanged from a roof or a windshield of an interior of a vehicle and holds a rectangular mirror, with being combined with the rectangular mirror as a multilayer structure.

Since one element of the dipole antenna is constructed of the dielectric antenna, the element can be far shortened as compared with $\lambda/4$. Accordingly, the other element, which is constituted of the ground pattern, of the dipole antenna can be approximately same length as $\lambda/4$, which is the length of the inside rear view mirror. As a result, the dipole antenna has approximately $\lambda/2$ length that can have a high reception performance, and the vehicular radio wave receiver can be made compactly. In addition, since the inside rear view mirror is disposed close to a windshield, it is suitable as receiving environment of a radio wave.

According to a fourth aspect of the present invention, an information displaying apparatus with a radio wave receiver includes a display, a circuit board, and a radio wave receiver. The radio wave receiver is disposed at a peripheral portion of the circuit board. The dielectric antenna extends in a certain direction. The ground pattern is an elongate form extended in a direction opposite to the dielectric antenna so that the dielectric antenna and the ground pattern function as elements of a dipole antenna.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

Figure 1:
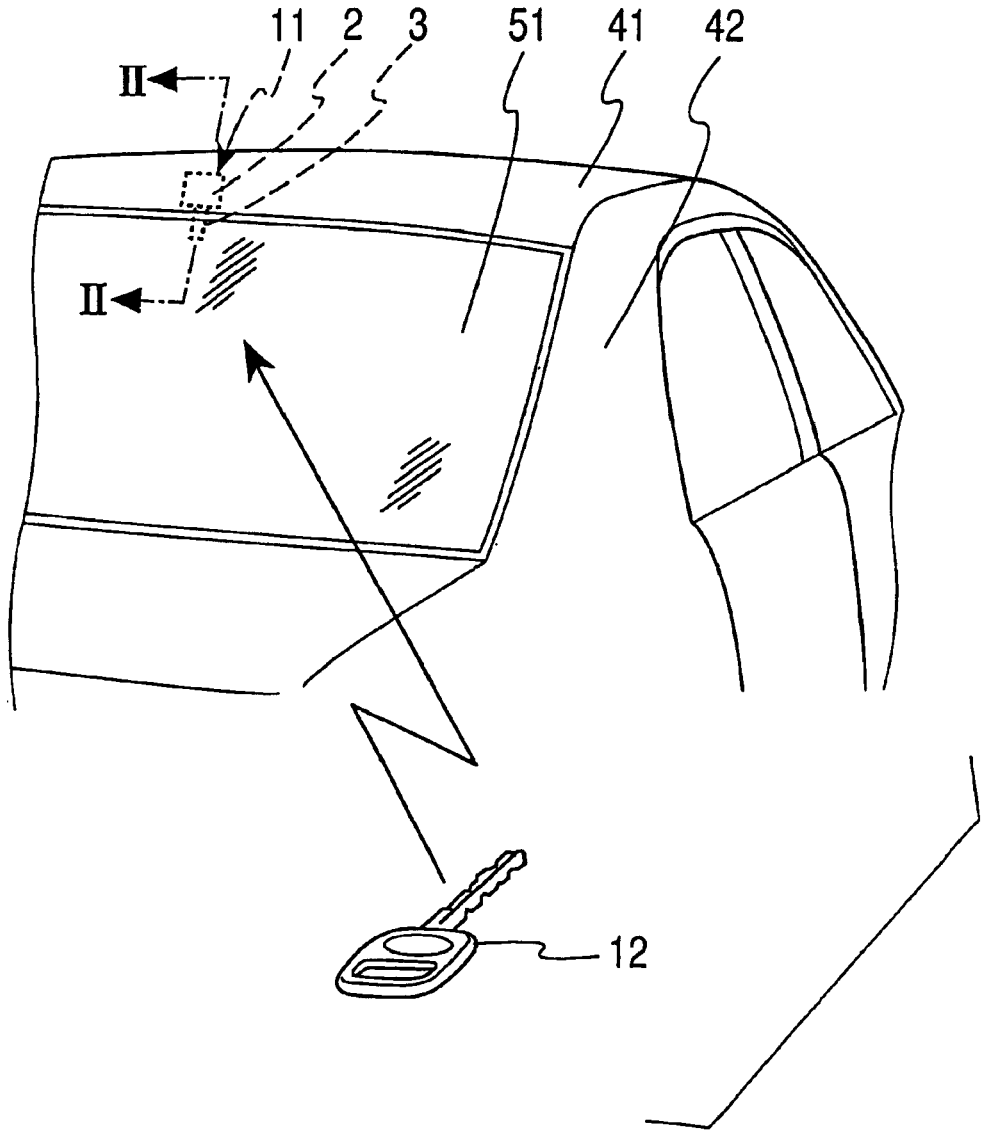
FIG. 1 is a perspective view showing a receiver mounted on a vehicle according to a first embodiment of the present invention.

The preferred embodiments of the present invention will be explained with reference to the accompanying drawings. In the drawing, the same numerals are used for the same components and devices.

[First Embodiment]

Figure 3:
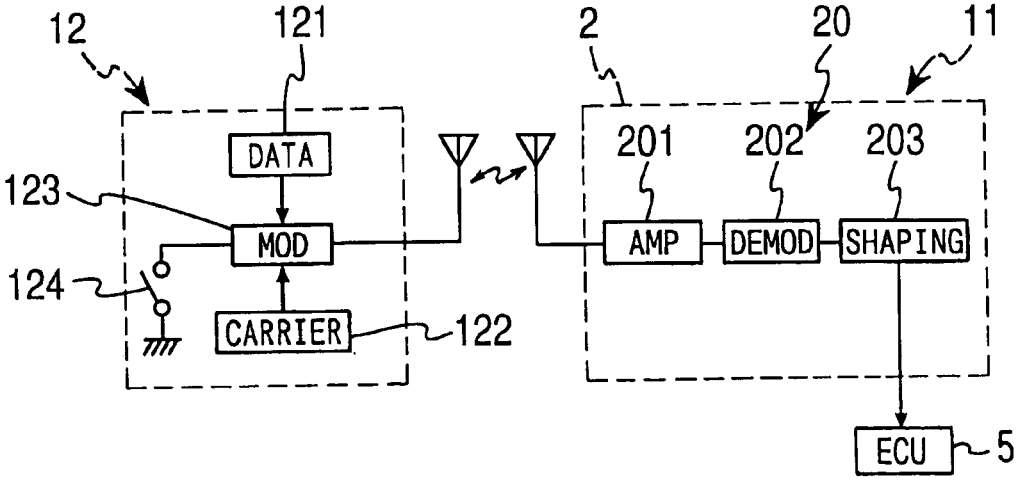
FIG. 3 is a block diagram of a transmitter and the receiver according to the first embodiment.

As shown in FIG. 3, a keyless entry system includes a receiver 11 for the keyless entry system and a transmitter 12 for the keyless entry system. The transmitter 12 is formed in a key as shown in FIG. 1. The transmitter 12 has a data generator 121, a carrier wave generator 122, a modulator 123, and a switch 124. The data generator 121 generates data signals, such as an identification (ID) code, which is assigned to each transmitter, and operation commands. The carrier wave generator 122 generates a carrier wave in 300-megahertz (MHz) band. When the switch 124 is operated by a driver, the modulator 123 modulates the carrier wave with the data signals, and transmits the modulated signals.

The receiver 11 has a receiving circuit 20 that has an amplifier (AMP) 201, a demodulator 202, and a waveform shaping circuit 203. The receiving circuit 20 receives the modulated signals, which are the data signals transmitted from the transmitter 12. The AMP 201 receives the received signals, and amplifies the received signals. The demodulator 202 demodulates the received signals. Then, the waveform shaping circuit 203 converts the demodulated signals into binary signals, which have "0" and "1", and outputs the binary signals to an electrical control unit (ECU) 5 for vehicular door control.

Figure 2:
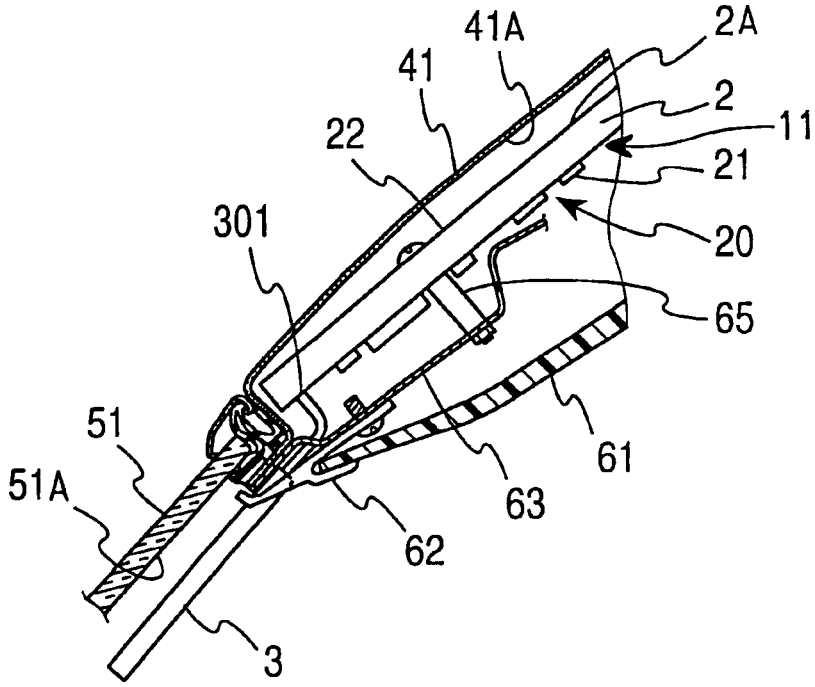
FIG. 2 is a sectional view taken along line II—II in FIG. 1.

As shown in FIG. 2, the receiver 11 has a circuit board 2, and electrical components 21, which constitute the receiving circuit 20, on a first surface of the circuit board 2. The receiver 11 is disposed close to a rear window 51 and inside a roof panel 41 that is a part of a vehicular body. The receiver 11 is covered with a head lining 61 to be hidden from the driver. The circuit board 2 is fixed to a roof rail 63 via a spacer 65 with a garnish 62 that holds the head lining 61 at the end thereof.

The spacer 65 has a certain length so that a second surface 2A of the circuit board 2 faces a rear surface 41A of the roof panel 41 closely. The second surface 2A is the other surface of the first surface that mounts the electrical components 21, and does not mount the electrical components. The second surface 2A has a ground pattern 22 in the entire surface. A distance between the surface 2A and the rear surface 41A is approximately ten millimeters (mm). At the rear windows side of the circuit board 2, an peripheral portion of the circuit board 2 is disposed close to the roof panel 41 and the rear window 51 in the forward and backward direction of the vehicle so that the peripheral portion of the circuit board 2 is prevented from touching to a back end of the roof panel 41.

A pole type dielectric antenna 3 is fixed to the circuit board 2 with the electrical components 21. One end of the antenna 3 is placed to the peripheral portion (edge) 301 of the circuit board 2 at the rear windows side, and the antenna 3 extends from the peripheral portion toward and along the rear window 51. The roof antenna 63 and the garnish 62 have notches in the extended direction of the antenna 3 so that the antenna 3 juts out into a vehicle compartment. Since the peripheral portion of the circuit board 2 is disposed close to the roof panel 41 and the rear window 51, most of the antenna 3 is opposite a rear surface 51*a* of the rear window 51. As a result, no metallic material exists between the antenna 3 and the outside of the vehicle.

As shown in FIG. 1, the circuit board 2 is disposed in the center of the roof panel 41 in the width direction. The antenna 3 is approximately fifty centimeters away from a rear pillar 42, which is made of metallic material in a radial direction of the dielectric antenna 3.

Figure 4:
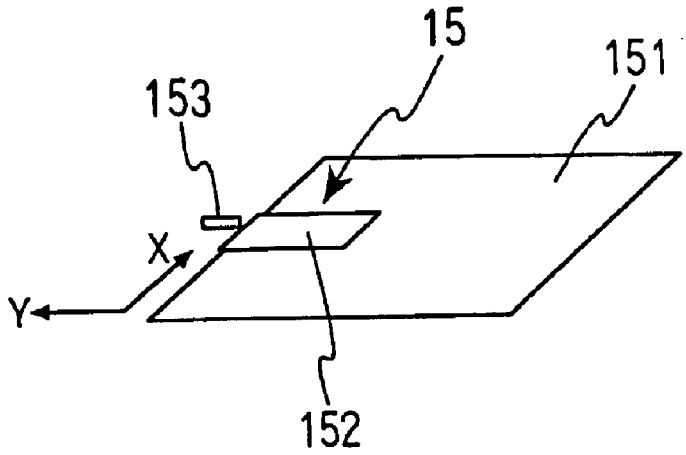
FIG. 4 is a schematic view to explain an operation of the receiver according to the first embodiment.
Figure 5:
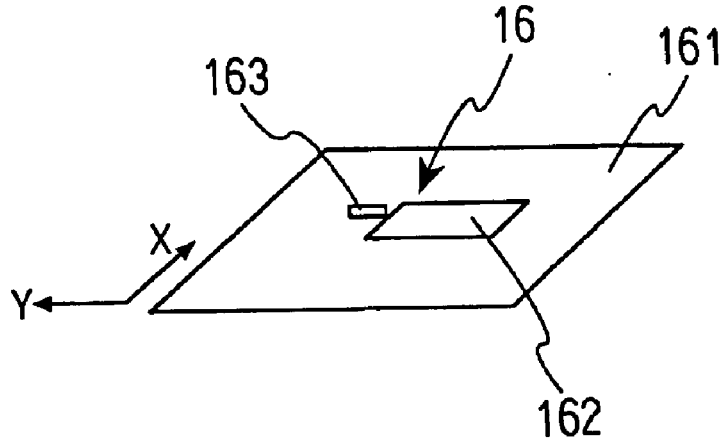
FIG. 5 is a schematic view of a comparative example.

A first experimental transmitter 15 and a second experimental transmitter 16 are shown in FIGS. 4 and 5, respectively. The first and second experimental transmitters 15 and 16 are set to operate in 300 Megahertz (MHz) frequency band, which is generally used in keyless entry system. Because of reversibility of a characteristic between transmitters and receivers, experimental results of the transmitters and the receivers are the same.

The first experimental transmitter 15 is the same structure as the receiver 11 of the present invention. The first experimental transmitter 15 has a circuit board 152 above a metallic board 151, and a dielectric antenna 153. The metallic board 151 measures 500 mm by 500 mm. The circuit board 152 is 10 mm away from the metallic board 151. The circuit board 152 has a ground pattern in one surface, and the surface faces the metallic board 151. Electrical components are omitted from FIG. 4 to simplify the drawing. An edge of the circuit board 152 is placed above an edge of the metallic board 151. One end (feeding point) of the dielectric antenna 153 is placed at a peripheral portion of the circuit board 152. The dielectric antenna 153 extends from the peripheral portion toward the outside in parallel with the metallic board 151. The metallic board 151 corresponds to the roof panel 41 of the receiver 11. Although the rear pillar 42 exists in the radial direction of the antenna 3, it is negligible as explained bellow.

The second experimental transmitter 16 as shown in FIG. 5 is a comparative example of the first experimental transmitter 15. The second experimental transmitter 16 has a circuit board 162 above a metallic board 161, and a dielectric antenna 163. The metallic board 161, the circuit board 162, and the dielectric antenna correspond to the metallic board 151, the circuit board 152, and the dielectric antenna 153 of the first experimental transmitter 15, respectively. However, a position of the second experimental transmitter 16 is different from that of the first experimental transmitter 15. That is, the second experimental transmitter 16 is placed above the center of the metallic board 161 with 10 mm away.

Figure 6A:
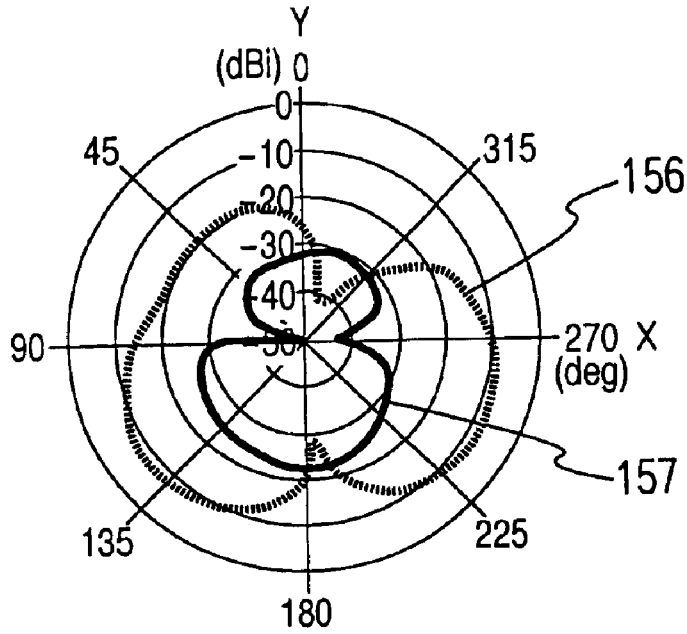
FIG. 6A shows radiation patterns on a X-Y plane according to the first embodiment.
Figure 6B:
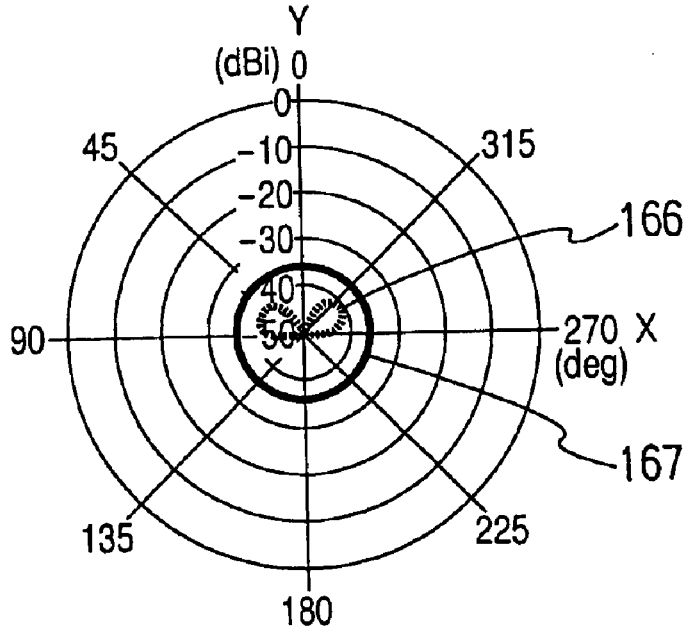
FIG. 6B shows radiation patterns on a X-Y plane according to the comparative example.

FIGS. 6A and 6B show measurement results of transmission strengths of the first experimental transmitter 15 (present invention) and the second experimental transmitter 16 (comparative example), respectively. The measurement results are measured in certain planes (X-Y plane) in parallel with the metallic boards 151 and 161. The directions "X" are orthogonal directions to the dielectric antennas 153 and 163. The directions "Y" are same directions as the dielectric antennas 153 and 163.

As shown in FIG. 6B, in the second experimental transmitter (comparative example) 16, a maximal strength of horizontally polarized waves is equal to −40 dBi, and a maximal strength of vertically polarized waves is equal to −36 dBi. That is, the second experimental transmitter 16 cannot have a sufficient transmission gain.

As shown in FIG. 6A, in the first experimental transmitter (present invention) 15, a maximum strength of horizontally polarized waves is equal to −9 dBi, and a maximum strength of vertically polarized waves is equal to −21 dBi. That is, the first experimental transmitter 15 has a sufficient transmission gain.

Figure 7:
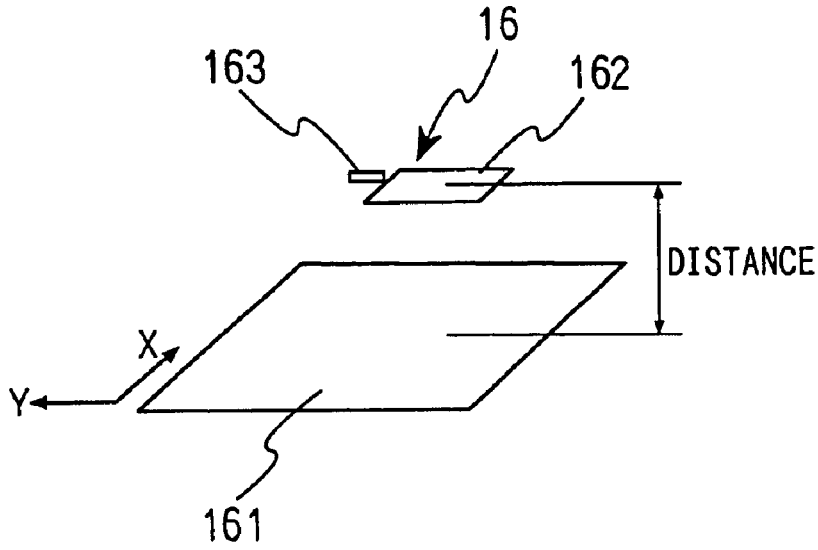
FIG. 7 is a schematic view of the comparative example.
Figure 8:
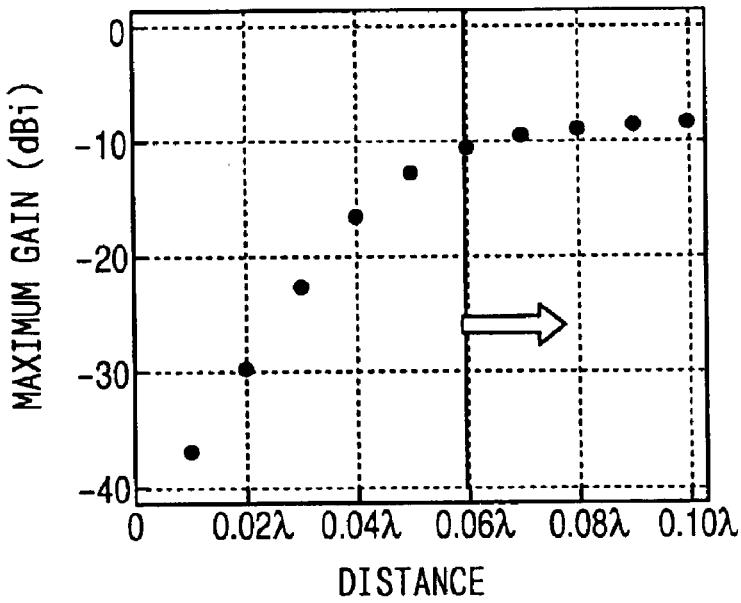
FIG. 8 shows measurement results of a maximum gain of the comparative example.

FIG. 8 shows measurement results of the maximum gain when the distance between the circuit board 162 and the metallic board 161 as shown in FIG. 7 are varied in multiple distances. When the distance is narrow, the transmission strength (maximum gain) becomes weak. When the distance is wide, the transmission strength becomes strong.

Figure 9:
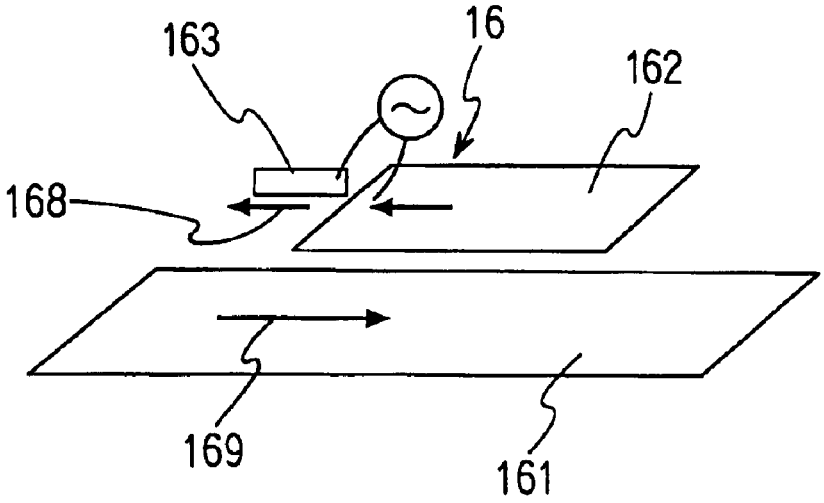
FIG. 9 is a schematic view of the comparative example.

As shown in FIG. 9, an electrical current flowing in the dielectric antenna 163 and an electrical current flowing in the metallic board 161 flow in opposite directions, thereby canceling the electrical currents. When the distance is narrow, a relation between the dielectric antenna 163 and the metallic board 161 becomes strong, and an influence of canceling the electrical currents also becomes strong. As a result, the transmission gain is reduced when the distance is narrow.

On the contrary, when the distance is wide, the relation between the dielectric antenna 163 and the metallic board 161 becomes weak. When the distance is greater or equal to 0.06 λ, the metallic board can be substantially ignored. Accordingly, although the rear pillar 42 exists in the width direction with respect to the receiver 11, which is a radial direction of the dielectric antenna 3, it can be negligible.

Referring to FIG. 6B, in the comparative example 16, the transmission strength becomes weak when the distance is narrow, thereby reducing the transmission gain. Referring to FIG. 6A, in the first experimental transmitter 15, since the edge of the circuit board 152 is placed above the edge of the metallic board 151 and the dielectric antenna 153 extends from the peripheral portion toward the outside. Accordingly, even if the circuit board 152 is placed closely above the metallic board 151, the relation between the metallic board 151 and the circuit board 152 does not become strong.

Figure 10:
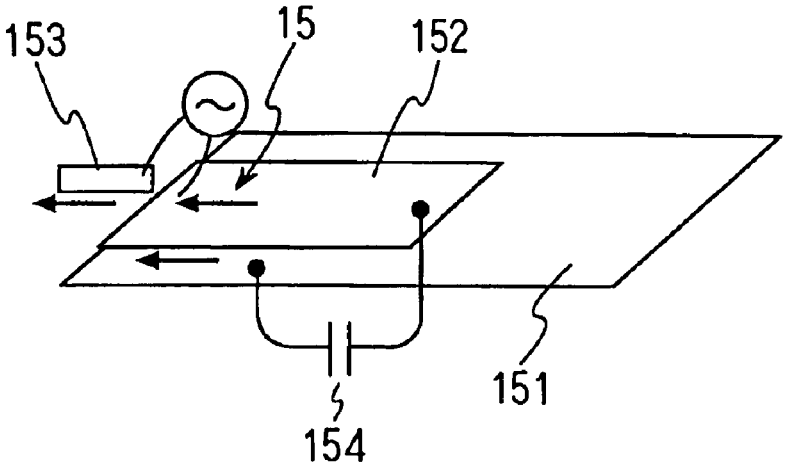
FIG. 10 is a schematic view of the first embodiment to explain the operation of the receiver according to the first embodiment.

As shown in FIG. 10, the metallic board 151 becomes ground because of capacitive coupling 154 between the metallic board 151 and the ground pattern of the circuit board 152. Since the metallic board 151 is broader than the ground pattern and becomes imaginary ground that has low resistance, the dielectric antenna 153 functions as an effective monopole antenna. Therefore, the first experimental transmitter 15 has high transmission gain in comparison with the second experimental transmitter 16.

The circuit board 2 is disposed in the center of the roof panel 41 in the width direction, which is a radial direction of the dielectric antenna 3, and the antenna 3 is disposed more than 0.06 λ away from the rear pillar 42 in 300 MHz frequency band. The position of the circuit board 2 is not limited to the position as shown in FIG. 1 wherever the circuit board 2 is more than 0.06 λ away from the rear pillar 42.

[Second Embodiment]

Figure 11:
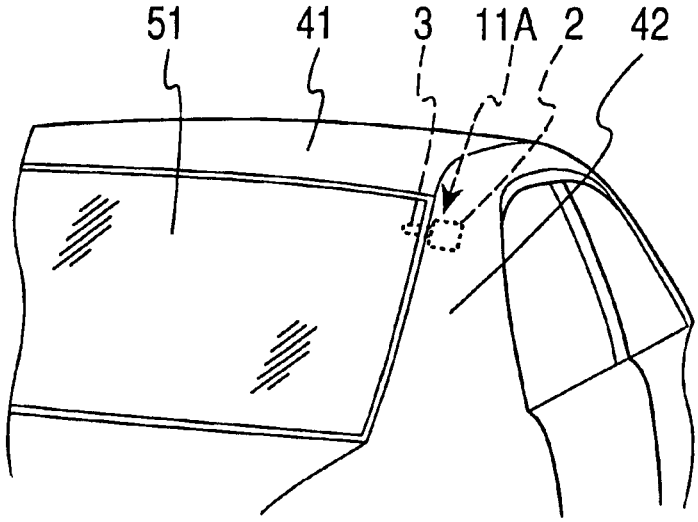
FIG. 11 is a perspective view showing a receiver mounted on the vehicle according to a second embodiment of the present invention.

Referring to FIG. 11, the circuit board 2 of a receiver 11A for the keyless entry system is disposed close to the rear window 51 and inside the rear pillar 42. The circuit board 2 is disposed close to the roof panel 41 so that the dielectric antenna 3 is located at a high position to have a higher gain. However, a distance between the dielectric antenna 3 and the roof panel 41 is set to be more than 0.06 λ away in 300 MHz frequency band. In such a second embodiment, the receiver 11A has a high reception performance same as the first embodiment.

[Third Embodiment]

Figure 12:
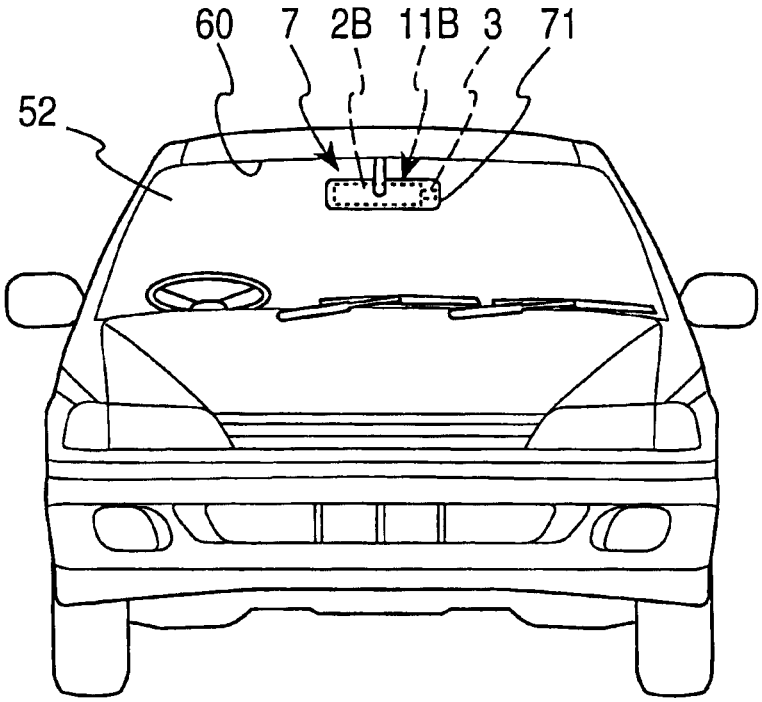
FIG. 12 is a front view showing a receiver mounted on the vehicle according to a third embodiment of the present invention.

Referring to FIG. 12, a second circuit board 2B of a receiver 11B for the keyless entry system is disposed inside a housing 71 of an inside rear view mirror 7, which is hanged from a roof 60 or a windshield 52. The housing 71 is made of synthetic resins.

Figure 13:
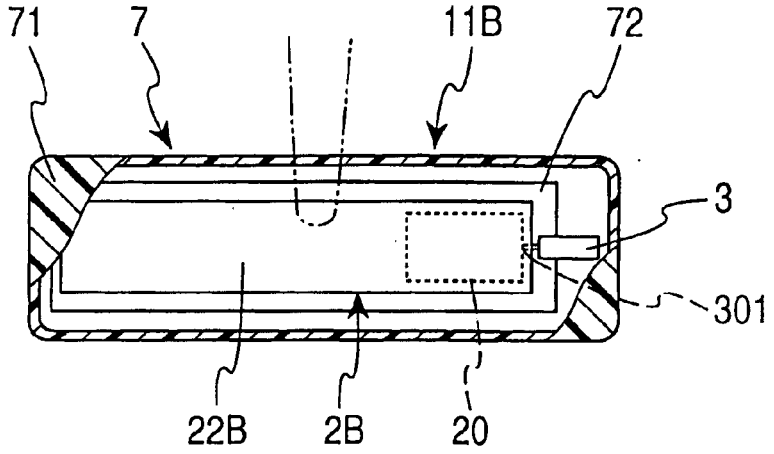
FIG. 13 is a partially sectional view of the receiver according to the third embodiment of the present invention.

Referring to FIG. 13, in condition that the housing 71 holds a rectangular mirror 72, the circuit board 2B is housed in a rear space of the mirror 72 (in front of the mirror 72 in FIG. 11). The circuit board 2B has a rectangular shape, which is a little smaller than the mirror 72, and is housed with being combined with the mirror 72 as a multilayer structure. The second surface 2A has a ground pattern 22B in the entire surface in the same manner as the first embodiment.

One end of the dielectric antenna 3 is fixed to a right side peripheral portion (edge) 301 of the circuit board 2B, and the antenna 3 extends from the peripheral portion 301 toward the lateral (horizontal) direction (in FIG. 11, right side). As a result, the dielectric antenna 3 and the ground pattern 22B function as elements of a dipole antenna so that the elements extend from the peripheral portion 301 toward the opposite direction.

In such a third embodiment, since one element of the dipole antenna is constructed of the dielectric antenna 3, the ground pattern 22B, which constitutes the other element of the dipole antenna, is approximately same length as the mirror 7. As a result, in effect the dipole antenna is constructed through the use of the housing 71, which has only a certain length corresponded to $\lambda/4$ in 300 MHz frequency band, so that the dipole antenna is corresponded to dipole antennas that have approximately $\lambda/2$ length.

In addition, the inside rear view mirror 7 is placed generally at a little below the roof 60 and at an upper side of the windshield 52, so that the receiver 11B can receive waves in the horizontal direction efficiently because no electrical component obstruct the waves.

A ground electrical potential is prevented from changing with influence of wire harnesses, such as for feeding and sending control signals to the circuit board 2B because the receiver 11B has the dipole antenna. Therefore, the receiver 11B has a high reception performance same as the first and second embodiments.

[Fourth Embodiment]

Figure 14:
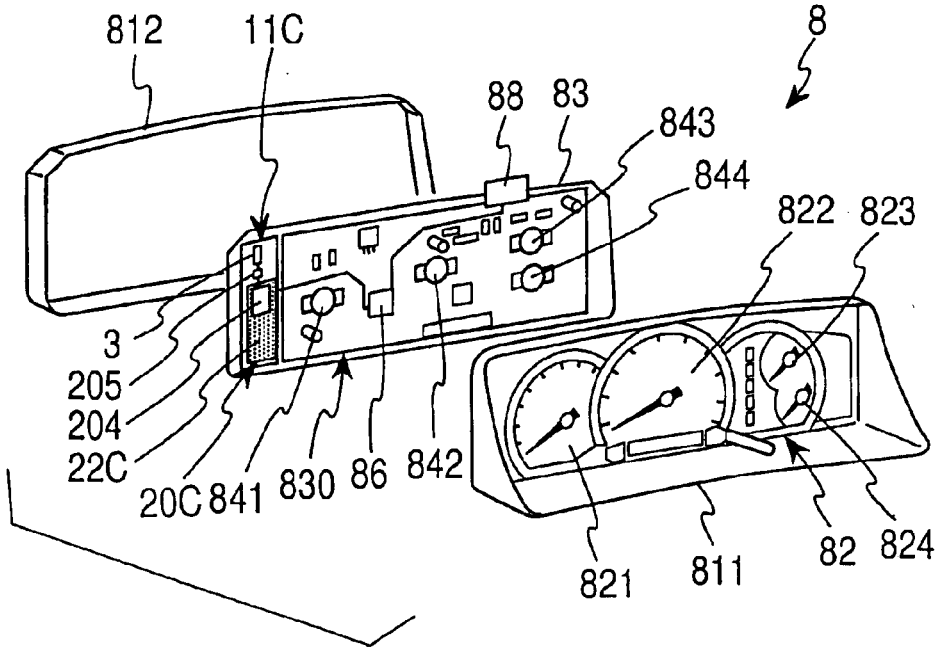
FIG. 14 is a disassembled view showing an instrument panel with a receiver according to a fourth embodiment of the present invention.

Referring to FIG. 14, an instrument panel 8 has an upper housing 811, a lower housing 812, and a meter circuit board 83. The instrument panel 8 has an internal radio wave receiver 11C. The upper housing. 811 and the lower housing 812 are fitted into a dash board of the vehicle. The upper housing 811 has a display 82 for displaying driving information, such as a speedometer 821, a tachometer 822, a water temperature meter 823, and a fuel meter 824. The meters 821 to 824 are generally arranged as shown in FIG. 14. That is, the tachometer 822 is arranged at the center of the upper housing 811, and the speedometer 821 is arranged at the left side of the tachometer 822. The water temperature meter 823 and the fuel meter 824, which are small, are arranged at the right side of the tachometer 822. As a result, the upper housing 811, the lower housing 812, and the circuit board 83 have long shape in the horizontal direction.

Figure 15:
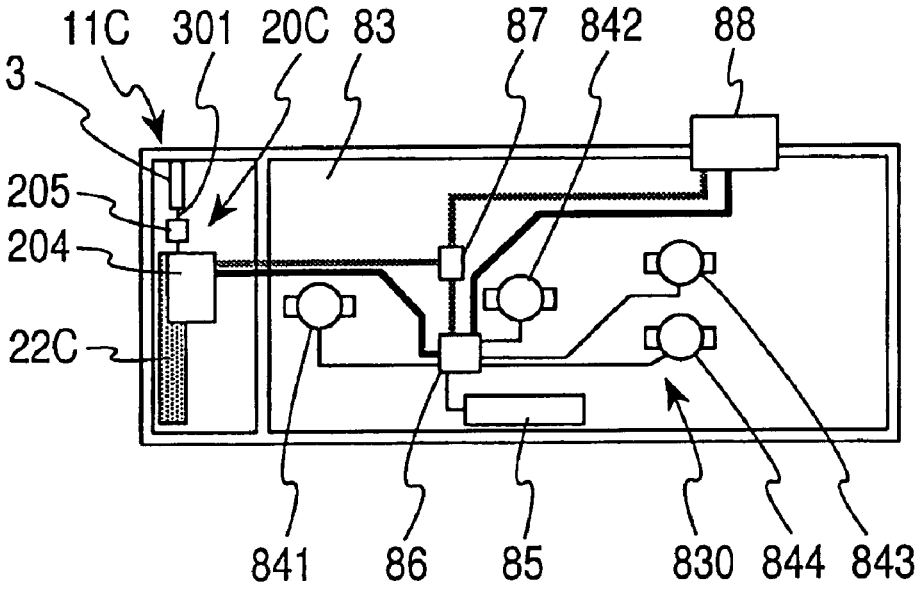
FIG. 15 is a plan view showing a circuit board of the instrument panel according to the fourth embodiment.

Referring to FIG. 15, the meter circuit board 83 has a control circuit 830 and the internal radio wave receiver 11C. The control circuit 830 has actuators 841, 842, 843, and 844, a Liquid Crystal Display (LCD) 85, a CPU 86, a power regulator 87, and a connector 88. The actuators 841, 842, 843, and 844 are used for actuating the meters 821, 822, 823, and 824, respectively. The LCD 85 displays a tripmeter. The CPU 85 controls the actuators 841 to 844 and the LCD 85. The power regulator 87 supplies the electrical power to the actuators 841 to 844, the LCD 85, and the CPU 86. The connector 88 is connected to the wire harnesses.

The control circuit 830 is arranged in the meter circuit board 83 to leave approximately one-sixth (⅙) region, which is a left side peripheral portion of the meter circuit board 83 in the lateral direction. The receiver 11C is arranged in the remaining one-sixth region.

The receiver 11C has the dielectric antenna 3, a receiving circuit 20C. The receiving circuit 20C has a demodulator 204 and an alignment circuit 205. The antenna 3 is disposed at an upper side of the meter circuit board 83 in a longitudinal direction of the meter circuit board 83. The alignment circuit 205 is disposed close to the edge 301. The demodulator 204 is disposed below the alignment circuit 205. In effect, the receiving circuit 20C is identical to the other receiving circuit 20 as described in the other embodiments.

A ground pattern 22C is formed on a back side of the meter circuit board 83 from a position of the alignment circuit 205 toward a bottom of the meter circuit board 83 in the longitudinal direction. The dielectric antenna 3 and the ground pattern 22C function as the elements of the dipole antenna so that the elements extend from the alignment circuit 205 toward the opposite direction.

In such a fourth embodiment, since one element of the dipole antenna is constructed of the dielectric antenna 3, the ground pattern 22C, which constitutes the other element of the dipole antenna, is approximately same length as the vertical axis of the meter circuit board 83. As a result, in effect the dipole antenna is structured through the use of the meter circuit board 83, which has only a certain longitudinal length corresponding to $\lambda/4$ in 300 MHz frequency band, so that the dipole antenna has a sufficient receiving gain corresponded to dipole antennas that have approximately $\lambda/2$ length.

In addition, the ground electrical potential is prevented from changing with influence of the wire harnesses connected to the connector 88 because the receiver 11C has the dipole antenna. Therefore, the receiver 11C has a high reception performance.

Since the one-sixth region is a peripheral portion of the meter circuit board 83, it is not a bottleneck to design the control circuit 830 when the receiver 11C is disposed in the region. Therefore, it is easy to provide the region, and to make the meter 8.

The receiver 11C can be disposed in a right side peripheral portion of the circuit board 83 if the control circuit 830 is disposed at the left side of the circuit board 83 due to a layout of the meters 821 to 824.

[Fifth Embodiment]

Figure 16:
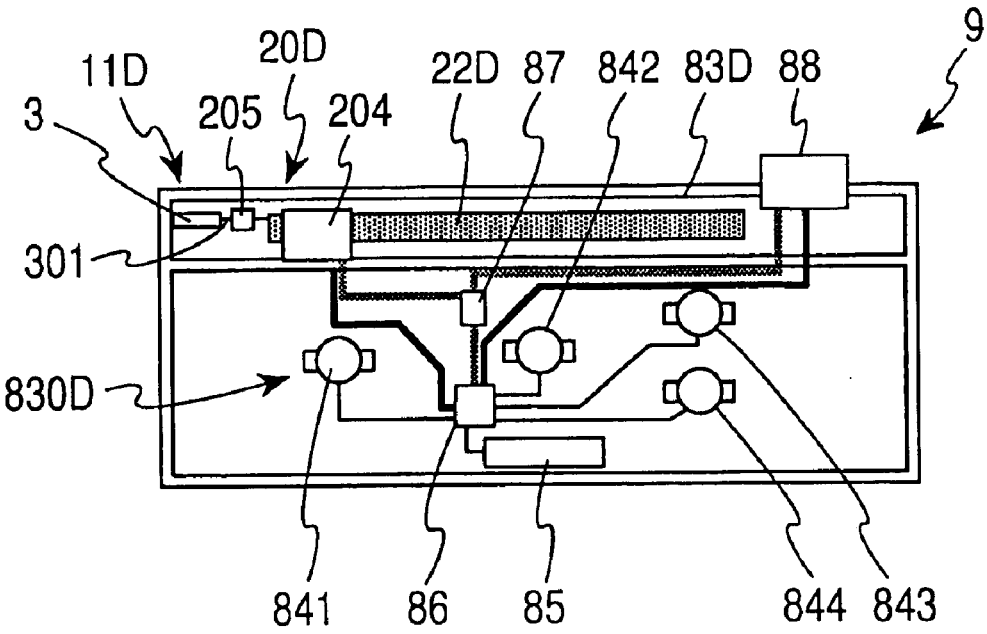
FIG. 16 is a plan view showing a circuit board of an instrument panel according to a fifth embodiment of the present invention.

An instrument panel 9 as shown in FIG. 16 is a modified example of the fourth embodiment as shown in FIGS. 14 and 15. The instrument panel 9 has an internal radio wave receiver 11D and a control circuit 830D on a meter circuit board 83D. The receiver 11D is disposed in one-fourth region, which is an upper side of the circuit board 83D. The control circuit 830D is a same structure as the control circuit 830 as shown in FIG. 15 other than wiring patterns for connecting to the receiver 11D, which is arranged in the different region from the receiver 11C of the fourth embodiment.

In the one-fourth region, the dielectric antenna 3 is disposed at a left periphery of the circuit board 83D in a lateral direction of the circuit board 83D. The alignment circuit 205 is disposed close to the edge 301. The demodulator 204 is disposed at the right side of the alignment circuit 205. The demodulator 204 and the alignment circuit 205 constitute of a receiving circuit 20D.

A ground pattern 22D is formed on a back side of the meter circuit board 83D from a position of the alignment circuit 205 toward the lateral direction to a vicinity of the connector 88, which is disposed at approximately one-sixth position from the right edge of the circuit board 83D. The dielectric antenna 3 and the ground pattern 22D function as the elements of the dipole antenna so that the elements extend from the alignment circuit 205 toward the opposite direction.

In such a fifth embodiment, since one element of the dipole antenna is constructed of the dielectric antenna 3, the ground pattern 22D, which constitutes the other element of the dipole antenna, has a sufficient length to the extent that one end of the ground pattern 22D extends the vicinity of the connector 88. The length of the circuit board 83D in the lateral direction can be used fully for the ground pattern 22D. As a result, in effect the dipole antenna is structured through the use of the meter circuit board 83D, which is difficult to prepare $\lambda/2$ length in 300 MHz frequency band, so that the dipole antenna has a sufficient receiving gain corresponded to dipole antennas that have approximately $\lambda/2$ length. Since the dielectric antenna 3 and the ground pattern 22D are disposed in the lateral direction of the circuit board 83D, the dipole antenna, which is constructed of the dielectric antenna 3 and the ground pattern 22D, can be arranged with a sufficient margin more than the fifth embodiment.

In addition, the ground electrical potential is prevented from changing with influence of the wire harnesses connected to the connector 88 because the receiver 11D has the dipole antenna. Therefore, the receiver 11D has a high reception performance.

Since the one-fourth region is a peripheral portion of the meter circuit board 83D, it is not a bottleneck to design the control circuit 830D when the receiver 11D is disposed in the region. Therefore, it is easy to provide the region, and to make the meter 9.

The receiver 11D can be disposed in a lower side of the circuit board 83D if the control circuit 830D is disposed at an upper side of the circuit board 83D due to a layout of the meters 821 to 824.

[Sixth Embodiment]

In the above embodiments, the receivers 11, 11A, 11B, 11C, and 11D are used for the keyless entry system. In the sixth embodiment, a receiver is used for the other system that uses high frequency waves.

Figure 17:
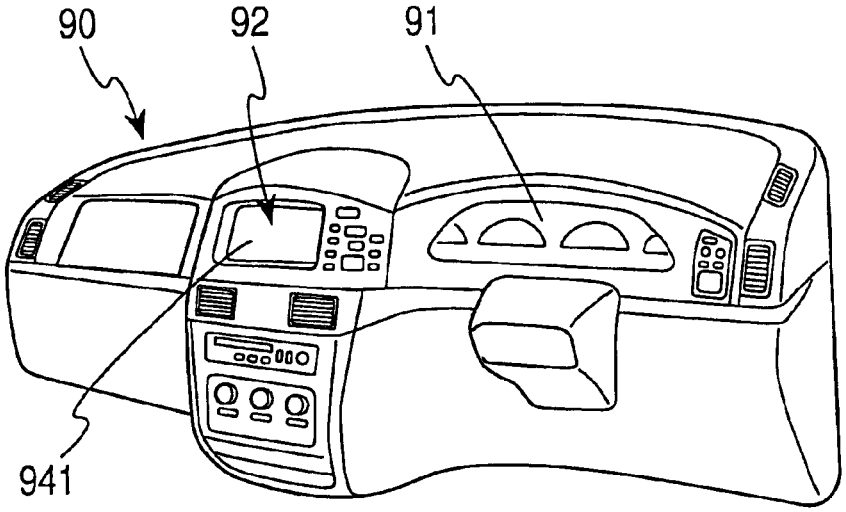
FIG. 17 is a perspective view showing a dashboard having a vehicle navigation system according to a sixth embodiment of the present invention.
Figure 18:
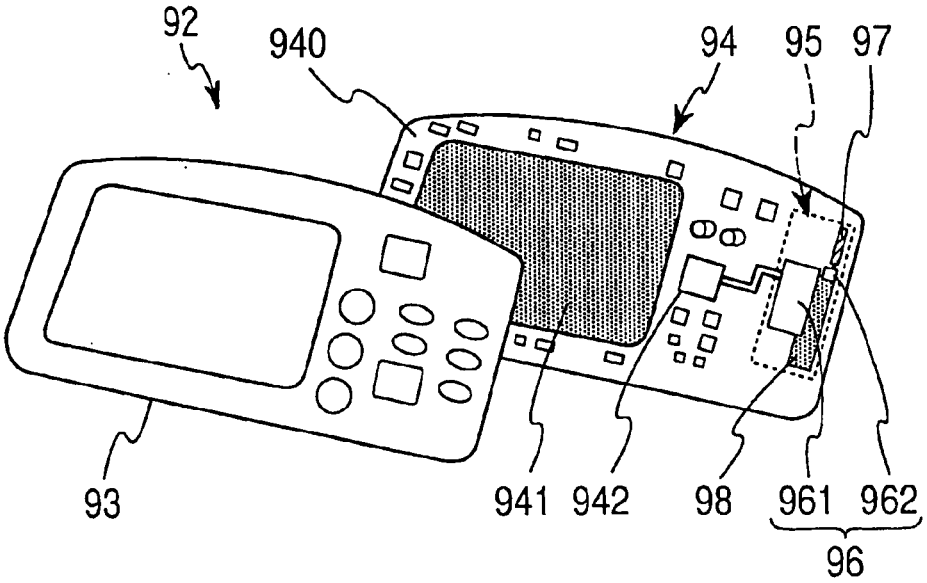
FIG. 18 is a perspective view showing the vehicle navigation system according to the sixth embodiment.

Referring to FIG. 17, a vehicular navigation system 92 is installed in a dashboard 90 with an instrument panel 91. As shown in FIG. 18, the vehicular navigation system 92 has a front panel 93 and a circuit board 94. The front panel 93 has a push keys to receive commands from users. The circuit board 94 is used for the vehicular navigation system, and has a Global Positioning System (GPS) receiver 95 and a control circuit 940. The GPS receiver 95 receives waves from GPS satellites in 1.5-gigahertz (GHz) frequency band. Most of the vehicular navigation system 92 is occupied with a rectangular monitor 941 in appearance. The monitor 941 shows a position of the vehicle with a map.

Figure 19:
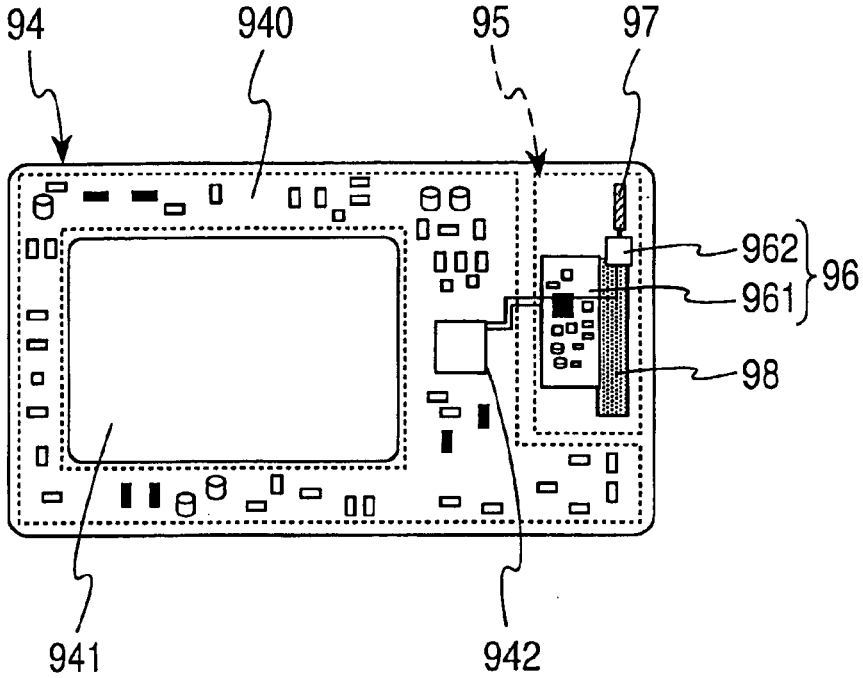
FIG. 19 is a plan view showing a circuit board of the vehicle navigation system according to the sixth embodiment.

As shown in FIG. 19, the circuit board 94 has the control circuit 940, the monitor 941, a CPU 942, and the GPS receiver 95. The circuit board 94 has a rectangular shape. The control circuit 940 is disposed on one surface of the circuit board 94. The monitor 941 is constructed of a LCD, which shows driving information, such as the map. The CPU 942 controls the monitor 941 based on the waves received with the GPS receiver 95 and operation signals received via the push keys. The control circuit 940, the monitor 941, and the CPU 942 is arranged in the circuit board 94 to leave approximately one-fifth (⅕) region, which is a right side peripheral portion of the circuit board 94 in the lateral direction. The GPS receiver 95 is arranged in the remaining one-fifth region.

The GPS receiver 95 has a receiving circuit 96 and a dielectric antenna 97. The receiving circuit 96 has a demodulator 961 and an alignment circuit 962. The dielectric antenna 97 is disposed at an upper side of the circuit board 94 in a longitudinal direction of the circuit board 94. The alignment circuit 962 is disposed close to a lower edge of the dielectric antenna 97. The demodulator 961 is disposed below the alignment circuit 962.

A ground pattern 98 is formed on a back side of the circuit board 94 from a position of the alignment circuit 962 toward a downward of the circuit board 94 in the longitudinal direction. The dielectric antenna 97 and the ground pattern 98 function as elements of a dipole antenna so that the elements extend from the alignment circuit 962 toward the opposite direction. Waves received with the dipole antenna is inputted into the demodulator 961 via the alignment circuit 962, the demodulator 961 produces signals to calculate a current position of the vehicle in the control circuit 940.

Since one element of the dipole antenna is constructed of the dielectric antenna 97, the ground pattern 98, which constitutes the other element of the dipole antenna, is approximately same length as the vertical axis of the circuit board 94. As a result, the dipole antenna is structured through the use of an edge region of the circuit board 94 in the lateral direction so that it has a sufficient receiving gain corresponded to dipole antennas that have approximately $\lambda/2$ length.

In addition, the ground electrical potential is prevented from changing with influence of the wire harnesses because the GPS receiver 95 has the dipole antenna. Therefore, the GPS receiver 95 has a high reception performance.

Since the one-fifth region is a peripheral portion of the circuit board 94, it is not a bottleneck to design the control circuit 940 when the GPS receiver 95 is disposed in the region. Therefore, it is easy to provide the region, and to make the vehicular navigation system 92.

The GPS receiver 95 can be disposed in the left side of the circuit board 94 if the control circuit 940 is disposed at the right side of the circuit board 94 due to a layout of the monitor 941.

[Seventh Embodiment]

Figure 20:
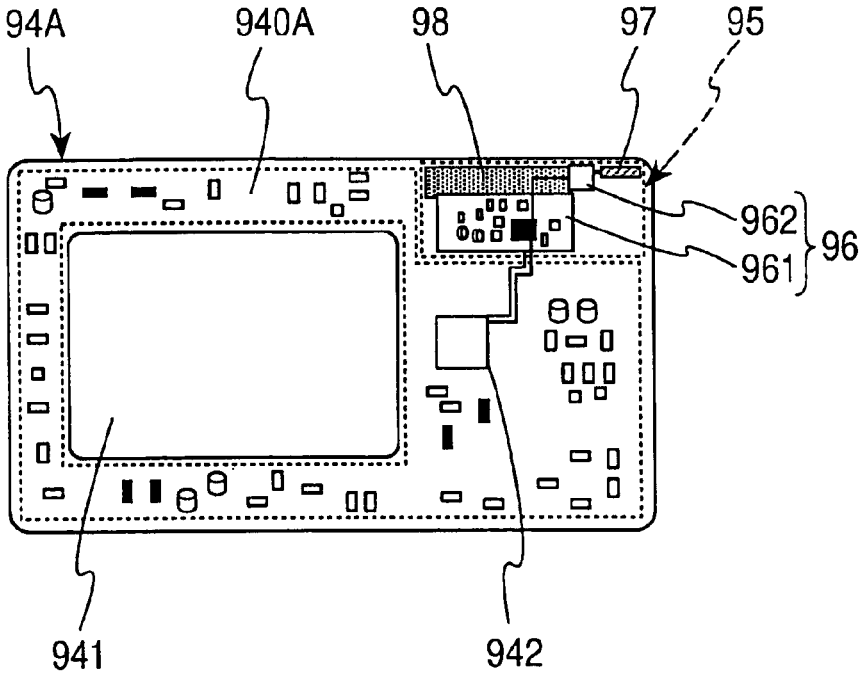
FIG. 20 is a plan view showing a circuit board of the vehicle navigation system according to a seventh embodiment of the present invention.

A circuit board 94A as shown in FIG. 20 is a modified example of the sixth embodiment as shown in FIG. 19. A layout of the circuit board 94A is modified from the circuit board 94 of the sixth embodiment. The circuit board 94A has a control circuit 940A, the monitor 941, the CPU 942, and the GPS receiver 95.

The dielectric antenna 97 is disposed at an upper and right side of the circuit board 94A in a lateral direction. One end of the dielectric antenna 97 is disposed close to the right end of the circuit board 94A. The alignment circuit 962 is disposed close to the other end of the dielectric antenna 97. The demodulator 961 is disposed below and at the left side of the alignment circuit 962.

A ground pattern 98 is formed on a back side of the circuit board 94A from a position of the alignment circuit 962 toward a left of the circuit board 94A in the lateral direction. The dielectric antenna 97 and the ground pattern 98 function as elements of a dipole antenna so that the elements extend from the alignment circuit 962 toward the opposite direction.

Since the dielectric antenna 97 and the ground pattern 98 are disposed in the lateral direction of the circuit board 94A, the dipole antenna, which has $\lambda/2$ length in effect by constructed of the dielectric antenna 97 and the ground pattern 98, can be arranged with a sufficient margin more than the sixth embodiment.

In addition, the ground electrical potential is prevented from changing with influence of the wire harnesses (not shown) because the GPS receiver 95 has the dipole antenna. Therefore, the GPS receiver 95 has a high reception performance.

Since the upper and right side region is a peripheral portion of the circuit board 94A, it is not a bottleneck to design the control circuit 940A when the GPS receiver 95 is disposed in the region. Therefore, it is easy to provide the region, and to make the vehicular navigation system 92 with the circuit board 94A.

The GPS receiver 95 can be disposed in the bottom side of the circuit board 94A if the control circuit 940A requires the region in which the GPS receiver 95 is disposed as shown in FIG. 20, due to a layout of components of the control circuit 940A.

[Eighth Embodiment]

Figure 21:
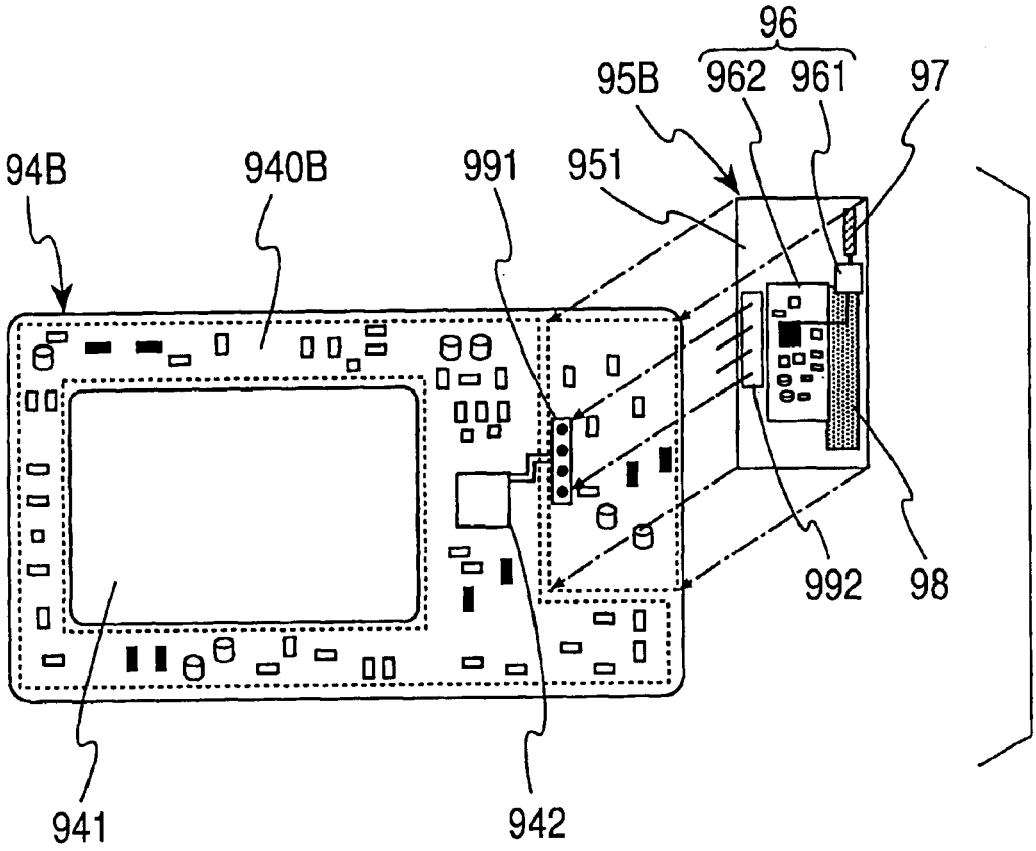
FIG. 21 is a plan view showing a circuit board of the vehicle navigation system according to an eighth embodiment of the present invention.

FIG. 21 shows a modified example of the sixth embodiment as shown in FIG. 19. A GPS receiver 95B is separated from a circuit board 94B. The GPS receiver 95B has a special receiving circuit board 951. The receiving circuit board 951 is mounted on the circuit board 94B. The circuit board 94B has a first connector 991. The receiving circuit board 951 also has a second connector 992. When the receiving circuit board 951 is mounted on the circuit board 94B, the receiving circuit board 951 and the circuit board 94B are electrically connected to each other via the pair of the connector 991 and 992. Output signals of the receiving circuit 96 are outputted to the CPU 942 of the control circuit 940B.

The receiving circuit board 951 requires approximately same region as the GPS receiver 95 of the sixth embodiment. Therefore, the circuit board 94B can prepare the attachment place of the GPS receiver 95B.

The present invention should not be limited to the embodiments discussed above and shown in the figures, but may be implemented in various ways without departing from the spirit of the invention. The present invention is applied to the other radio wave receiving circuits and the other information displaying apparatuses. For example, it is applied to a driving information displaying apparatus that displays driving information, such as own vehicle information, road information, and area information, for the driver through the use of a radio wave communication system via the Internet or a specified Local Area Network (LAN). In addition, frequency bands used in the receiver are not limited to the 300 MHz and 1.5 GHz, and the other frequency bands, such as an UHF and microwave, can be used in the receiver.

What is claimed is:

1. A vehicular radio wave receiver provided inside a vehicle that has a panel as a body of the vehicle and a window linked with the panel at an edge of the panel, comprising:

a circuit board having a receiving circuit on a first surface of the circuit board and a ground pattern on a second surface that is opposite to the first surface; and a dielectric antenna that has a shape of a pole and receives a signal to send the signal to the circuit board, wherein the circuit board is disposed close to the edge of the panel so that the ground pattern closely faces an inner surface of the panel, and the dielectric antenna is axially disposed along the window as extending from a peripheral portion of the circuit board close to the edge of the panel.

2. The vehicular radio wave receiver according to claim 1, wherein the dielectric antenna is disposed not less than 0.06 $\lambda$ away from a metallic member of the vehicle in a radial direction of the dielectric antenna, and the symbol $\lambda$ is a wavelength.

3. A vehicular radio wave receiver provided inside a vehicle comprising:

a circuit board having a receiving circuit and a ground pattern; and a dielectric antenna that has a shape of a pole and receives a signal to send the signal to the circuit board, wherein at least one side of the circuit board in a lateral direction or a longitudinal direction has $\lambda/4$ length, and the symbol $\lambda$ is a wavelength, the dielectric antenna is disposed as extending from a peripheral portion of the circuit board to an outside of the circuit board, and the ground pattern of the circuit board is an elongate form extended in a direction opposite to the dielectric antenna so that the dielectric antenna and the ground pattern function as elements of a dipole antenna.

4. A vehicular radio wave receiver provided inside a vehicle having an inside rear view mirror, which is hanged from a roof or a windshield of an interior of the vehicle and holds a rectangular mirror in a housing of the inside rear view mirror, comprising:

a circuit board having a receiving circuit and a ground pattern; and a dielectric antenna that has a shape of a pole and receives a signal to send the signal to the circuit board, wherein the circuit board is housed in the housing of the inside rear view mirror with being combined with the rectangular mirror as a multilayer structure, the dielectric antenna is disposed as extending from a peripheral portion of the circuit board to an outside of the circuit board in a lateral direction of the circuit board, and the ground pattern of the circuit board is an elongate form extended in a direction opposite to the dielectric antenna so that the dielectric antenna and the ground pattern function as elements of a dipole antenna.

* * * * *